US006032987A

United States Patent [19]

Fukumoto et al.

[11] Patent Number: 6,032,987

[45] Date of Patent: Mar. 7, 2000

[54] SLIDING DOOR LOCKING DEVICE

[75] Inventors: Ryoichi Fukumoto, Nagoya; Kazuya Makiuchi; Mamoru Nishihira, both of Sagamihara; Masakatsu Tsubouchi, Toyota, all of Japan

[73] Assignee: Aisin Seiki Kabushiki Kaisha, Kariya, Japan

[21] Appl. No.: 09/081,048

[22] Filed: May 19, 1998

[51] Int. Cl.[7] ..... E05C 3/06

[52] U.S. Cl. ..... 292/216; 292/201; 292/DIG. 23

[58] Field of Search ..... 292/216, 201, 292/DIG. 23

[56] References Cited

U.S. PATENT DOCUMENTS

| | | | |
|---|---|---|---|
| 4,968,074 | 11/1990 | Yamagishi et al. | 292/216 |
| 5,015,020 | 5/1991 | Mizuki | 292/216 |
| 5,100,185 | 3/1992 | Menke et al. | 292/216 |
| 5,618,068 | 4/1997 | Mitsui et al. | 292/216 |
| 5,709,420 | 1/1998 | Umino | 292/216 |

FOREIGN PATENT DOCUMENTS 5-3550 1/1993 Japan .

*Primary Examiner*—Steven Meyers
*Assistant Examiner*—Teri Pham
*Attorney, Agent, or Firm*—Burns, Doane, Swecker & Mathis, L.L.P.

[57] ABSTRACT

A sliding door locking device has a fully opened condition locking mechanism and a fully closed condition locking mechanism for locking a sliding door to a vehicle body when the sliding door is at its fully opened position and fully closed position, respectively. When an inside handle is rotated in one direction for closing the sliding door, the inside handle is connected only to the fully opened condition locking mechanism for releasing the fully opened condition locking mechanism. On the other hand, when the inside handle is rotated in the other direction for opening the sliding door, the inside handle is connected to both the fully opened condition locking mechanism and the fully closed condition locking mechanism for releasing both.

19 Claims, 8 Drawing Sheets

SLIDING DOOR LOCKING DEVICE

This application corresponds to and claims priority under 35 U.S.C. § 119 with respect to Japanese Application No. 09(1997)-142929, the entire content of which is incorporated herein by reference.

1. Field of the Invention

The present invention generally relates to door locks. More particularly, the present invention pertains to a sliding door locking device.

2. Background of the Invention

In van-type vehicles, the lateral side of the vehicle body is provided with a front door opening and a rearwardly located door opening. For opening and closing the front door opening, a swing type door is typically used whereas for opening and closing the rear door opening a sliding door is generally used.

The sliding door is adapted to be moved along an upper rail, an intermediate rail and a lower rail for movement between a fully closed position and a fully opened position. The upper rail, intermediate rail and lower rail are provided at the inside upper portion, the outside intermediate portion, and the inside lower portion, respectively, of the vehicle body.

While the sliding door is in the fully closed position, the sliding door is fitted within the rear opening. This fully closed position is maintained by a fully closed condition locking mechanism which is defined by a hook provided on the sliding door that engages a striker on the vehicle body. On the other hand, while the sliding door is in the fully opened position, the sliding door is positioned adjacent the outside portion of the vehicle body with a clearance being provided between the door and the vehicle body. This condition is maintained by a fully opened condition locking mechanism which is defined by another hook and striker arrangement. This mechanism serves to prevent unexpected closure of the sliding door when the vehicle is parked on a downwardly sloping road with its rear end pointing uphill.

When a passenger sitting on the rear seat wants to close the sliding door located in the fully opened position, the passenger must first manipulate the inside handle to bring the fully opened condition locking mechanism into its released condition under which the hook is disengaged from the striker. It is then possible to move the sliding door along the rails to effect closure of the door.

However, in the foregoing sliding door locking device as disclosed in, for example, Japanese Utility Model Laid-Open Publication No. 1993-3550 published without examination on Jan. 19, 1993, the inside handle is also in association with the fully closed condition locking mechanism. Therefore, whenever one of the locking mechanisms is manipulated, the other is also simultaneously manipulated. This means that a relatively large force is required when the fully opened condition locking mechanism is released.

In light of the foregoing, a need exists for a sliding door locking device which is not susceptible of the disadvantages and drawbacks associated with other known sliding door locking devices.

It would be desirable therefore to provide a sliding door locking device which does not require a large force when the fully opened condition locking mechanism is released.

SUMMARY OF THE INVENTION

In accordance with one aspect of the invention, a sliding door locking device includes a fully opened condition locking mechanism and a fully closed condition locking mechanism, with the device being operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism. The sliding door locking device includes an inside handle rotatable about a fixed pivot in a first direction for effecting opening of the sliding door and rotatable about the fixed pivot in a second direction for effecting closing of the sliding door, a first input lever rotatable about an axis for receiving a force resulting from rotation of the inside handle to effect closing of the sliding door, and a second input lever rotatable about the axis for receiving a force resulting from rotation of the inside handle to effect opening of the sliding door. A full opening lever is rotatably disposed on a shaft that is spaced apart from the axis of the first input lever for receiving a force resulting from rotation of the first input lever, and a full closing lever is rotatably disposed on the shaft and is connected to the second input lever via a link mechanism. The rotation of the first input lever acts only upon the full opening lever for producing an unlatched state of the fully opened condition locking mechanism, and the rotation of the second input lever acts upon both the full opening lever and the full closing lever for producing the unlatched state of the fully opened condition locking mechanism and an unlatched state of the fully closed condition locking mechanism.

According to another aspect of the invention, a sliding door locking device includes a fully opened condition locking mechanism and a fully closed condition locking mechanism, with the device being operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism. The sliding door locking device includes an inside handle rotatable about a fixed pivot in a first direction for effecting opening of the sliding door and rotatable about the fixed pivot in a second direction for effecting closing of the sliding door, a first input lever rotatable about an axis for receiving a force resulting from rotation of the inside handle for effecting closing of the sliding door, a second input lever rotatable about the axis for receiving a force resulting from rotation of the inside handle for effecting opening of the sliding door, a full opening lever rotatable on a shaft that is spaced from the axis of the first input lever for receiving a force resulting from rotation of the first input lever, and a full closing lever rotatable on the shaft and connected to the second input lever via a link mechanism. The first input lever acts upon only the full opening lever during rotation of the first input lever to produce an unlatched state of the fully opened condition locking mechanism, and the second input lever acts upon at least the full closing lever during rotation of the second input lever to produce at least an unlatched state of the fully closed condition locking mechanism.

According to another aspect of the invention, a sliding door locking device includes a fully opened condition locking mechanism and a fully closed condition locking mechanism, with the device being operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism. The sliding door locking device includes an inside handle rotatable about a fixed pivot in a first direction for effecting unlatching of the fully closed condition locking mechanism and rotatable about the fixed pivot in a second direction for effecting unlatching of the fully opened condition locking mechanism, a first input lever rotatable about an axis and engageable by the inside handle during rotation of the inside handle in the second direction, and a second input lever rotatable about the axis and engageable by the inside handle during rotation of the inside handle in the first direction. A full opening lever is adapted to be connected to the fully opened condition locking mechanism and is rotatable on a shaft that is spaced from the axis of the first input lever for rotating in response to rotational movement of the first input lever to effect unlatching of the fully opened condition locking mechanism. A full closing lever is adapted to be connected to the fully closed condition locking mechanism and is rotatable on the shaft. The full closing lever is also operatively connected to the second input lever for rotating in response to rotational movement of the second input lever to effect unlatching of the fully closed condition locking mechanism. The full closing lever is isolated from the first input lever so that rotational movement of the inner handle in the second direction is prevented from being transmitted to the full closing lever.

BRIEF DESCRIPTION OF THE DRAWING FIGURES

The above and other features and details associated with the present invention will become more apparent from the following detailed description considered with reference to the accompanying drawing figures in which like elements are designated by like reference numerals and wherein;

Fig 4 is a front view similar to FIG. 2 illustrating the device when the child protection mechanism is turned on;

DETAILED DESCRIPTION OF THE INVENTION

Figure 8:
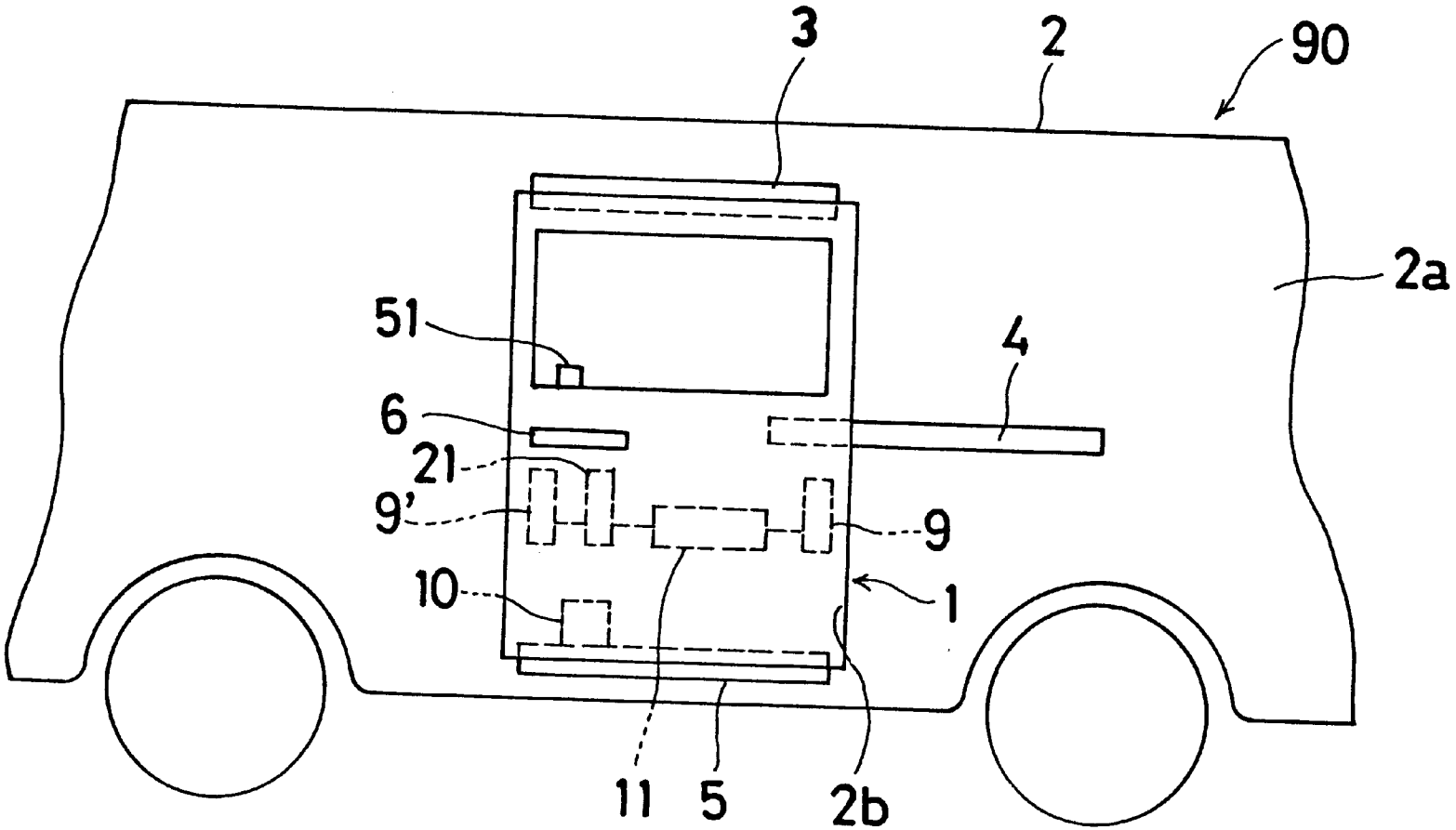
FIG. 8 is a schematic illustration of the relationship between the device shown in FIG. 1 and various other parts of the sliding vehicle door.

FIG. 8 illustrates the arrangement of the sliding door locking device of the present invention and its relation to the vehicle door and other related components. A vehicle 90 includes a vehicle body 2 having a lateral side 2*a*. A door opening 2*b* is formed in the lateral side 2*a* of the vehicle body 2. Other openings that are also provided in the vehicle body 2 are not illustrated for purposes of simplicity.

The opening 2*b* in the lateral side 2*a* of the vehicle body 2 is adapted to be closed and opened by a sliding door 1 which is movable along an upper rail 3, an outer intermediate rail 4, and a lower rail 5. The upper rail 3 is provided at the upper inner portion of the vehicle body 2 while the lower rail 5 is provided at the lower inner portion of the vehicle body 2. The intermediate rail 4 is located at the intermediate portion of the lateral side of the vehicle body 2. The sliding door 1 is movable between a fully closed position and a fully opened position.

When the sliding door 1 is in the fully closed position, the sliding door 1 is locked in position with respect to the vehicle body 2 by a pair of fully closed condition locking mechanisms 9, 9', Each of the fully closed condition locking mechanisms 9, 9' includes a hook connected to the sliding door 1 and a striker secured to the vehicle body 2. When the sliding door 1 is in the fully opened position, the sliding door 1 is locked in position with respect to the vehicle body 2 by a fully opened condition locking mechanism 10. This fully opened condition locking mechanism 10 includes a hook provided on the sliding door 1 and a striker secured to the vehicle body 2. The position of the aforementioned strikers and hooks is not illustrated in the drawing figures as such is known in the art.

The outer side of the sliding door 2 is provided with an outside handle 6. The inside of the sliding door 2 is provided with an inside handle 21 and a locking knob 51. As will be described in more detail below, the fully closed condition locking mechanisms 9, 9' and the fully opened condition locking mechanism 10 are manipulated by way of a locking device 11 when one of the handles 6, 21 is operated.

Figure 1:
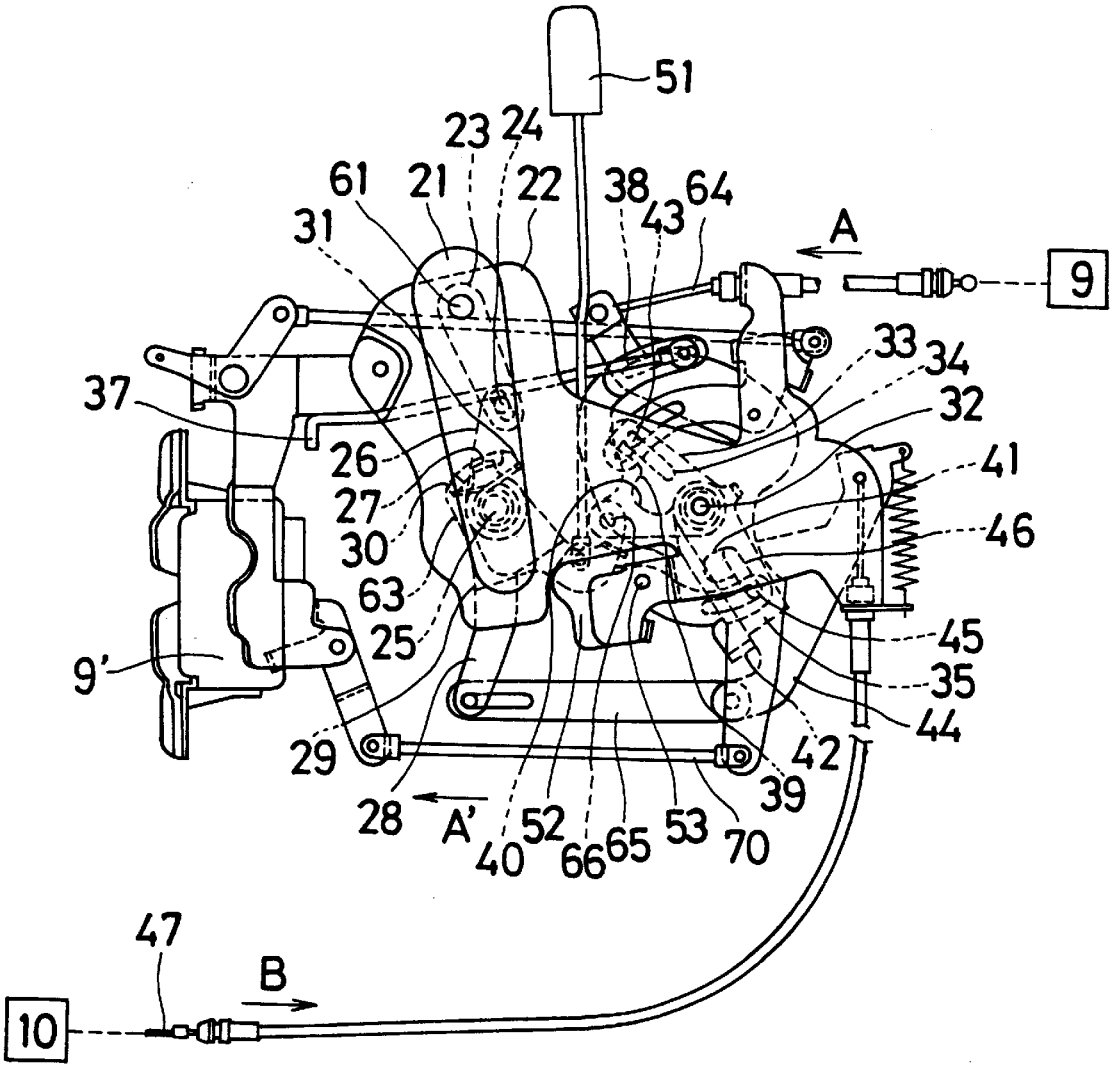
FIG. 1 is a front detailed view of the inside structure of a sliding door locking device according to the present invention when the device is in the fully closed condition is ready to be released.
Figure 2:
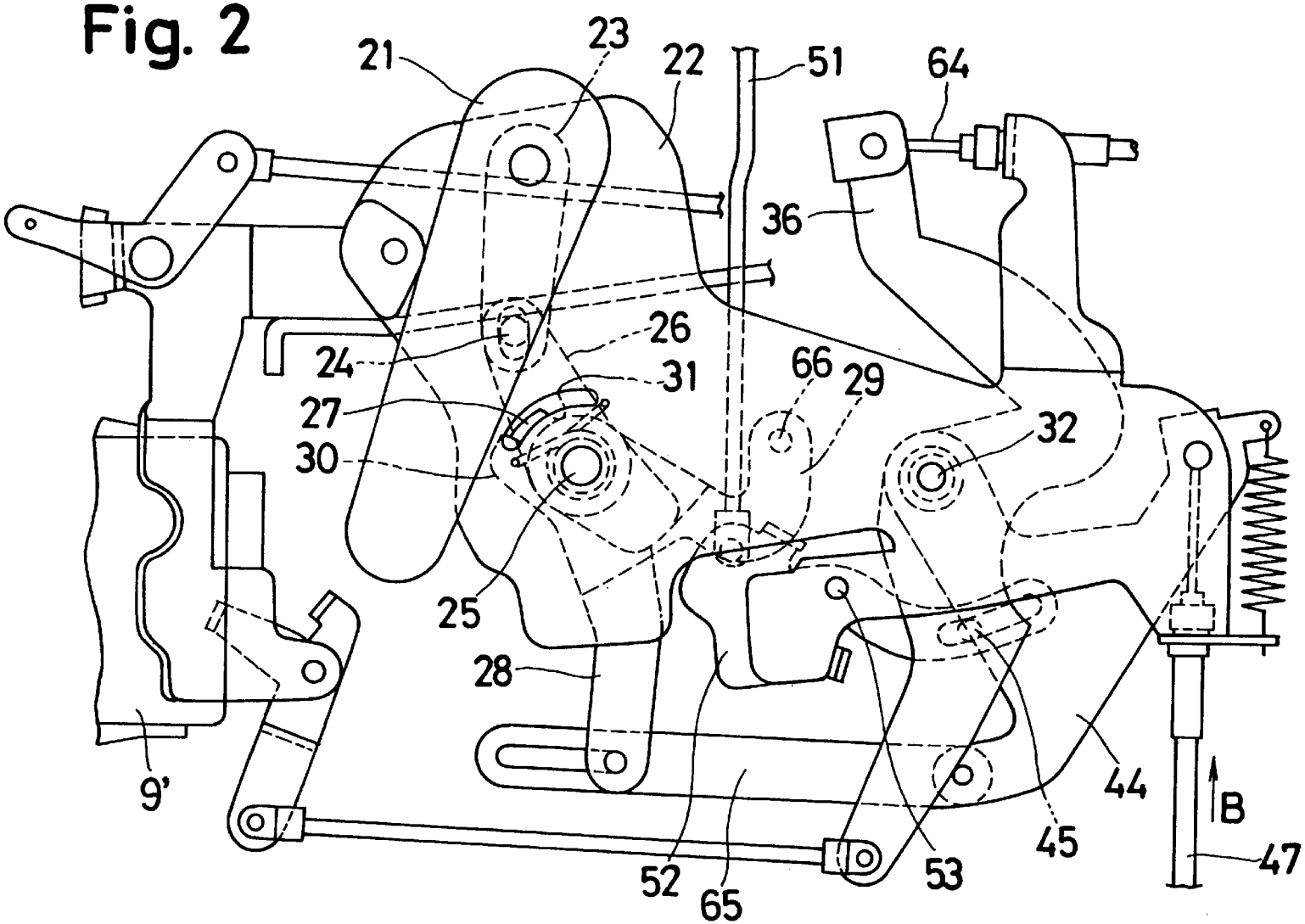
FIG. 2 is a front view similar to FIG. 1 illustrating the device is being transferred to the fully closed condition.

Referring to FIGS. 1 and 2, the locking device 11 identified in FIG. 8 includes a bracket 22 to which the inside handle 21 is rotatably connected by a pin 61. An arm 23 is integrally formed with the inside handle 21 at the back side of the inside handle 21. The arm 23 is connected via a pin 24 to a handle lever 26 which is rotatably mounted on a fixed pivot 25. The handle lever 26 has a projection 27 which is located between the abutting portion 30 of a first input lever 28 and the abutting portion 31 of a second input lever 29. The first input lever 28 and the second input lever 29 are under the influence of the urging force of a spring 63 and are rotatably mounted on the fixed pivot 25.

The second input lever 29 is connected to an intermediate lever 33 by way of a pin 66. The intermediate lever 33 is rotatably mounted on a shaft 32 which is secured to the bracket 22 for being isolated from the fixed pivot 25. A slot 34 is provided in the intermediate lever 33 and receives a pin 43 of a child protecting mechanism, the details of which will be described in more detail below.

Rotatably mounted on the shaft 32 are an output lever 35, a full closing lever 36, and a full opening lever 44. A slot 38 is formed in the end portion of the output lever 35 for receiving a rod 37 that is operatively connected to the outside handle 6 as will be described in more detail below. The output lever 35 has also a pin receiving wall 39 and a pin escaping recess 40. The end portion of the output lever 35 that is opposite to the slot 38 is provided with an L-shaped cam slot 41 and an abutting projection 42. The pin receiving wall 39 receives a pin 43 which passes through the slot 34 of the intermediate lever 33. The abutting projection 42 of the output lever 35 is in abutment with a side of the full opening lever 44.

A pin 45 passing through a vertical portion of the cam slot 41 also passes through a slot 46 in the full closing lever 36, thereby connecting the output lever 35 and the full closing lever 36. The full opening lever 44 is connected to the first input lever 28 through a connecting link 65.

Figure 6:
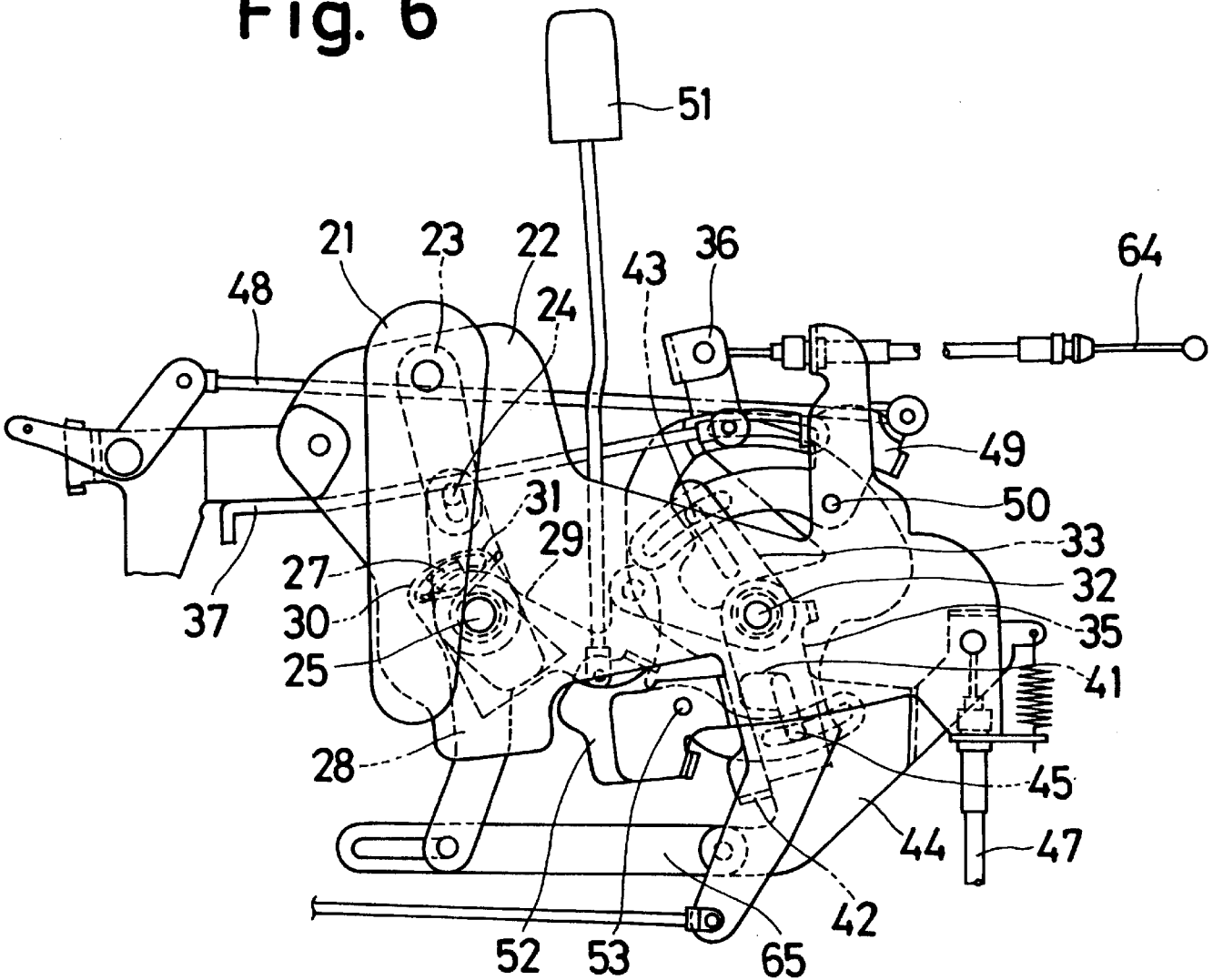
FIG. 6 is a front view similar to FIG. 2 illustrating the device in the neutral condition.

FIG. 1 shows the condition after rotating the inside handle 21 which is at a neutral position as shown in FIG. 6 for opening the sliding door 1. In FIG. 1, the opening direction of the inside handle 21 corresponds to the counter-clockwise direction. The counter-clockwise movement of the inside handle 21 pushes, via the arm 23 and the projection 27 of the handle lever 26, the abutting portion 31 of the second input member 29 and the second input member 29 is rotated in the clockwise direction in FIG. 1 against the urging force of the spring 63. The resultant or clockwise rotation of the second input lever 29 brings the intermediate lever 33 into counter-clockwise rotation about the shaft 32, the pin 43 passing through the slot 34 of the intermediate lever 33 urges the pin receiving wall 39, and the output lever 35 is brought into counter-clockwise rotation about the shaft 32. The resultant movement of the output lever 35 is transmitted via the pin 45 to the full closing lever 36, thereby rotating the full closing lever 36 in the counterclockwise direction about the shaft 32. Thus, a cable 64 is pulled in the direction of arrow A shown in FIG. 1 and a rod 70 is moved in the direction of arrow A' in FIG. 1. This results in the fully closed condition locking mechanisms 9, 9' being released. The released or unlatched state of the fully closed condition locking mechanism 9, 9' involves disengagement of a hook from a striker. Establishment of the unlatched state of each of the fully closed condition mechanisms enables the sliding door 1 to be opened.

The counter-clockwise rotation of the output lever 35 causes the abutting projection 42 to urge the side of the full opening lever 44, which results in the counter-clockwise rotation of the full opening lever 44 about the shaft 32. Thus, a cable 47 is pulled in the direction of arrow B in FIG. 1 and the fully opened locking mechanism 10 is brought into an unlatched condition. Immediately when the sliding door 1 reaches the fully opened position, the hook is brought into engagement with the striker in the mechanism 10, thereby establishing a latched state.

With reference to FIG. 2, the closing movement of the sliding door 1 is explained. If the inside handle 21 is rotated in the clockwise direction, the projection 27 of the first input lever 26 causes a counter-clockwise rotation of the first input lever 28. Because the end of the input lever 28 is connected to the full opening lever 44 via a connecting link 65, the counter-clockwise rotation of the first input lever 28 causes a counter-clockwise rotation of the full opening lever 44 about the shaft 32, resulting in the cable 47 being pulled in the direction of arrow B. Thus, the fully opened condition locking mechanism 10 is brought into the unlatched state, which results in the sliding door 1 being ready to be closed. It is to be noted that the counter-clockwise rotation of the first input lever 28 is established independent of the intermediate lever 33 and the output lever 35. Thus, the full closing lever 36 is isolated from the first input lever 28 upon counter-clockwise rotation of the first input lever 28, which means that the force required for closing the sliding door 1 becomes smaller.

Figure 3:
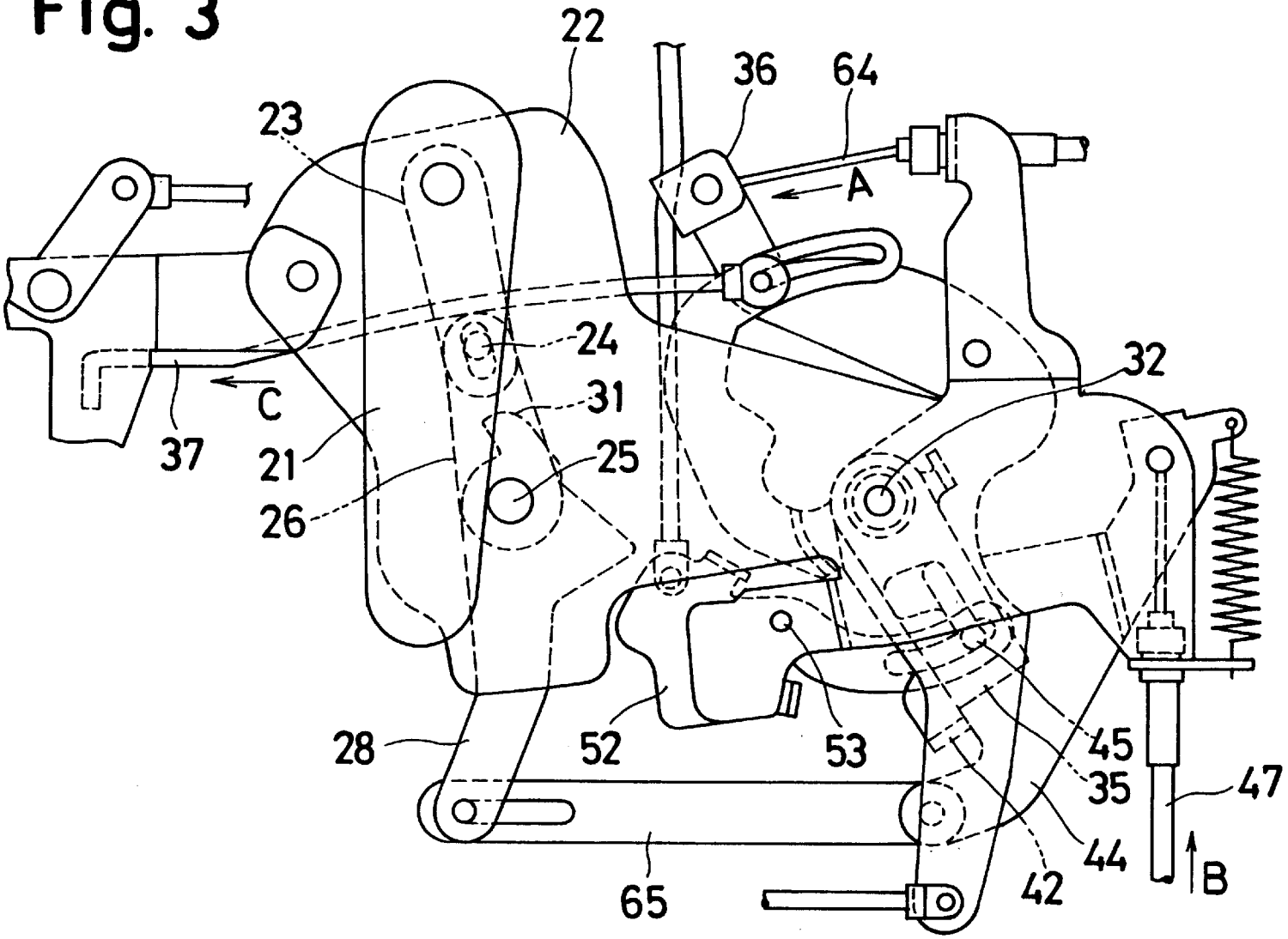
FIG. 3 is a front view similar to FIG. 2 illustrating the device when the outside handle is manipulated.

The opening and closing operation of the sliding door 1 by manipulating the outside handle 6 is described with reference to FIG. 3. When the outside handle 6 is manipulated, the rod 37 is moved in the direction of arrow C, thereby rotating the output lever 35 about the shaft 32 in the counter-clockwise direction. The abutting portion 42 of the output lever 35 under the resultant rotation causes a counter-clockwise rotation of the full opening lever 44 about the shaft 32. Thus, the cable 47 is pulled in the direction of arrow B, which results in an establishment of the unlatched state of the fully opened condition locking mechanism 10.

The counter-clockwise rotation of the output lever 35 is transmitted via the pin 45 to the full closing lever 36, thereby establishing a counter-clockwise rotation thereof about the shaft 32. The resultant rotation of the full closing lever 36 pulls the cable 64 in the direction of the arrow A, resulting in the fully closed condition locking mechanism 9 (9') assuming its unlatched state, thereby enabling movement of the sliding door 1.

Figure 4:
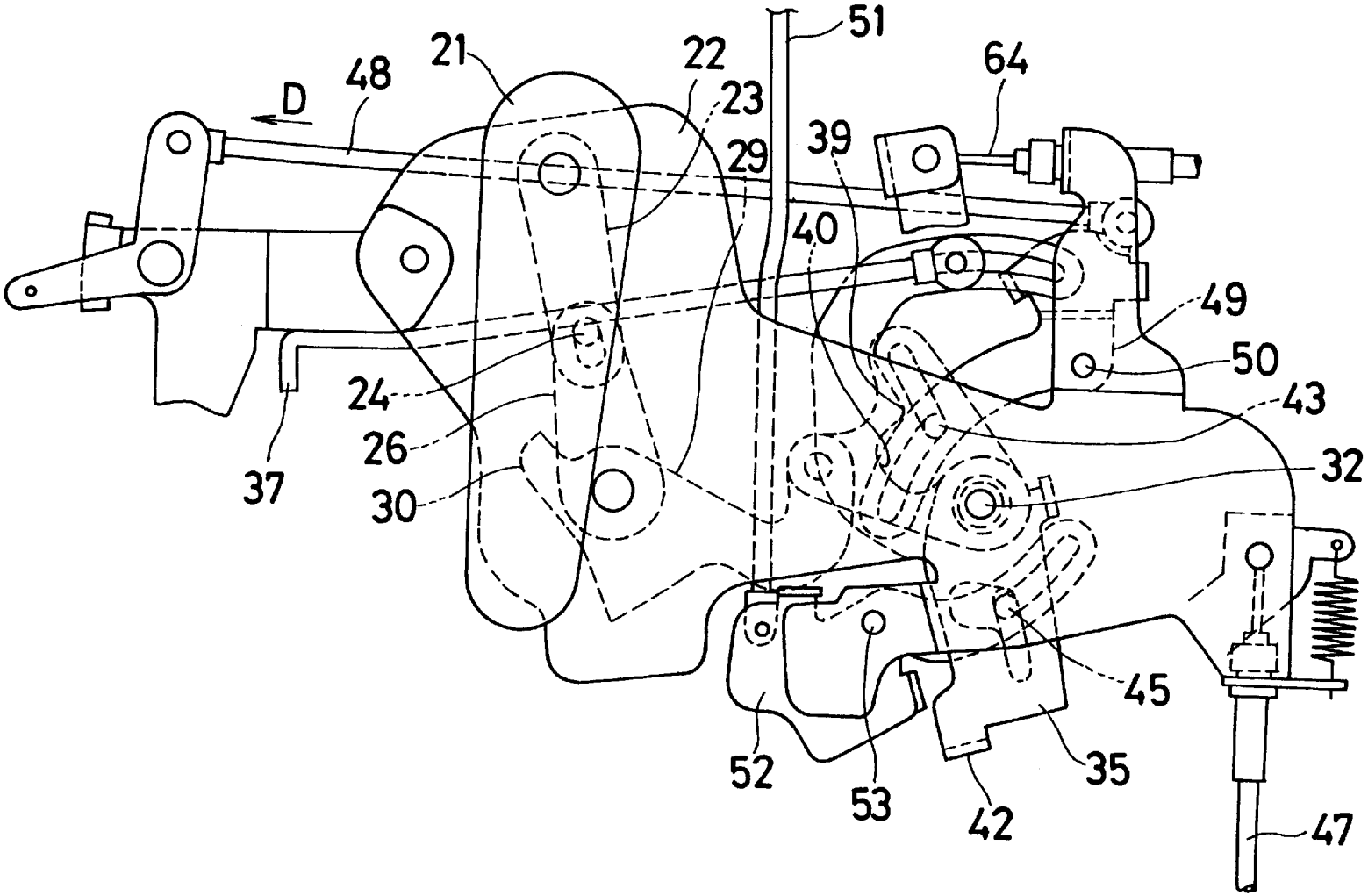

As shown in FIG. 4, when a child protecting mechanism is actuated, a rod 48 which is an element of the child protecting mechanism is pulled in the direction of the arrow D, thereby rotating a child link 49 in the counterclockwise direction about a fulcrum 50. This causes a movement of the pin 43 into the pin escaping recess 40 due to the opposing relationship between the pin 43 and the pin receiving wall 39. Thus, even though the inside handle 21 is rotated for opening the sliding door 1, the pin 43 in the pin escaping recess 40 remains out of engagement with the output lever 35 and fails to establish rotation thereof. Thus, in the event of an unexpected manipulation of the inside handle 21 in the opening direction of the sliding door 1 caused by a child when the child protecting mechanism is in its locked condition, the sliding door 1 remains closed. On the other hand, the rotation of the inside handle 21 for closing the sliding door 1 can be established independent of the child protecting mechanism.

Figure 5:
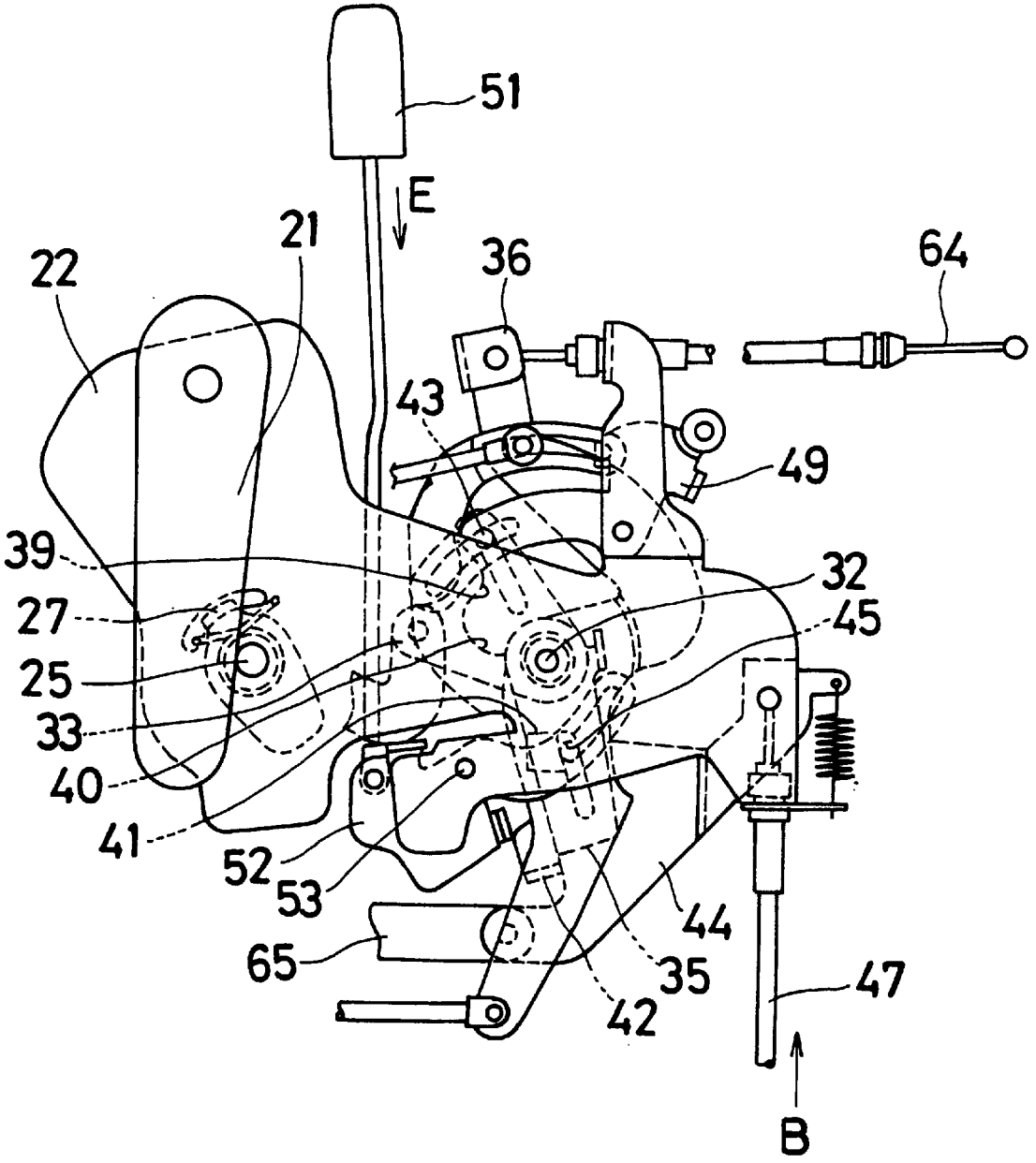
FIG. 5 is a front view similar to FIG. 2 illustrating the device when the locking knob is manipulated.

The function associated with the locking knob 51 is explained with reference to FIG. 5. When the locking knob 51 is pushed down in the direction of arrow E, a locking knob lever 52 is rotated in the counter-clockwise direction about a fulcrum 53. The resultant rotation of the locking knob lever 52 moves the pin 45 into a horizontal portion of the L-shaped cam slot 41 formed in the output lever 35. Thus, even if the output lever 35 is rotated in the counter-clockwise direction about the shaft 32 when a force is transmitted to the pin receiving wall 39 from the pin 43 through manipulation of the inside handle 21, the pin 45 can move only within the horizontal portion of the slot 41. As a result, the movement of the output lever 35 cannot be transmitted to the full closing lever 36. Thus, the fully closed condition locking mechanism 9 (9') is prevented from being brought into its unlatched state.

On the other hand, the counter-clockwise rotation of the output lever 35 by manipulating the outside handle 6 causes the counterclockwise rotation of the full opening lever 44 by way of the abutting portion 42, thereby pulling the cable in the direction of arrow B. Though the resultant movement of the cable 47 brings about the unlatched state of the fully opened condition locking mechanism 10, such an establishment of the unlatched state thereof is of no significance when the sliding door 1 is in its fully closed position.

While the sliding door 1 is in its fully opened position, it is possible to bring the sliding door 1 into its fully closed position by manipulating the outside handle 6 independent of the locking knob 51. Similar to the child protecting mechanism, the locking knob 51 is isolated from the inside handle 21 when the inside handle 21 is manipulated for closing the sliding door 1. Thus, independent of the locking knob 51, the sliding door 1 can be transferred from its fully opened position to its fully closed position by manipulating the inside handle 21.

Figure 7:
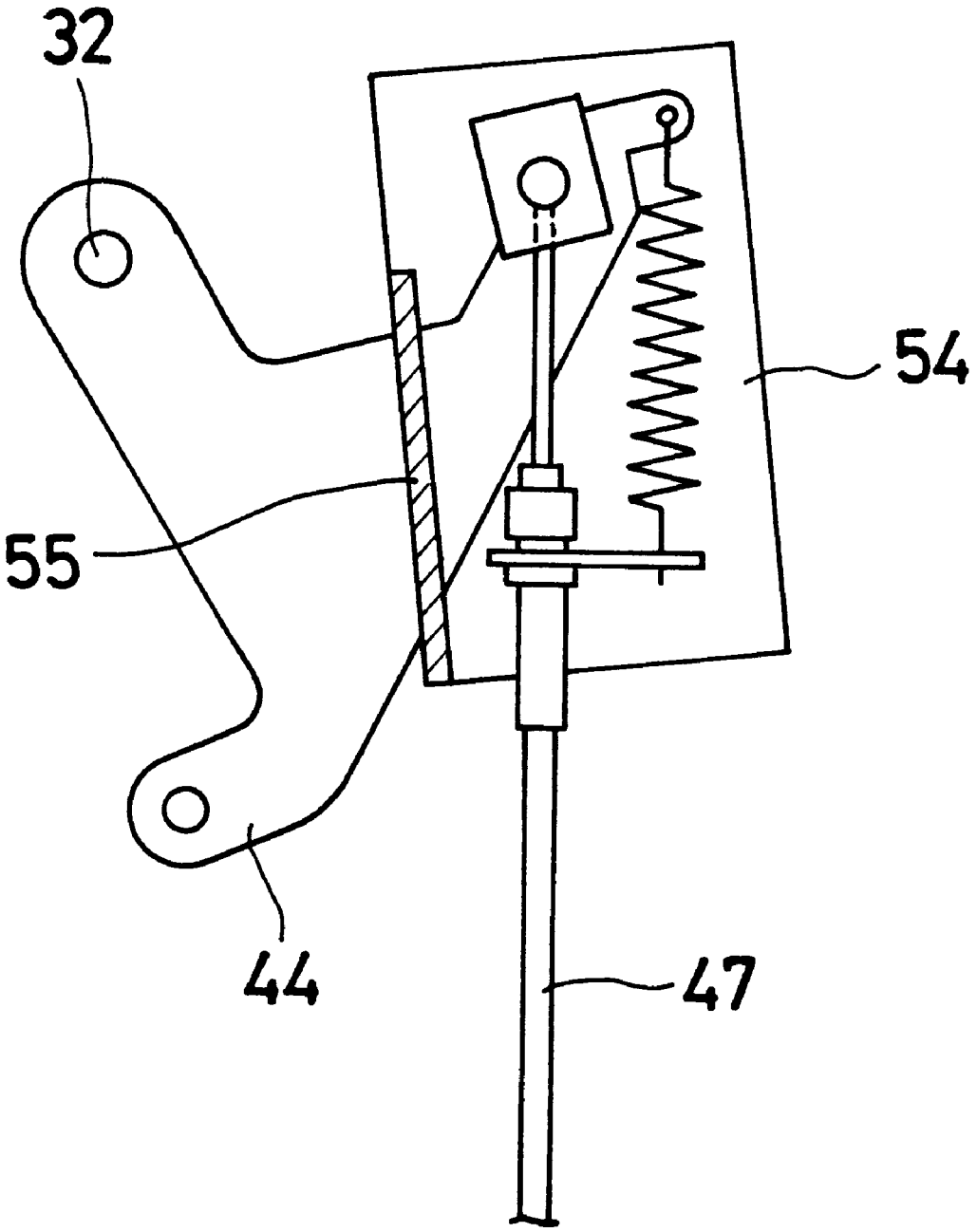
FIG. 7 is a front view of a portion of the device shown in FIG. 1 illustrating the cover located at the place where the full opening locking lever and the cable are connected.

As shown in FIG. 7, the region of connection between the full opening lever 44 and the cable 47 is enclosed by a cover 54 made of a synthetic resin. The cover 54 is closed at its connecting portion 55 by way of a bonding agent. A lower end portion of the cover 54 is formed with an open configuration for allowing the passage of the cable 47. The cover 54 prevents the splashing of rain or water into the area of the connection between the full opening lever 44 and the cable 47. Thus, the connection between the full opening lever 44 and the cable 47 can remain ice-free during cold seasons.

It can be seen that by virtue of the present invention, the release of the fully opened condition locking mechanism does not require an excessively large force.

The principles, a preferred embodiment and the mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A sliding door locking device having a fully opened condition locking mechanism and a fully closed condition locking mechanism and operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism, the sliding door locking device comprising:

an inside handle rotatable about a fixed pivot in a first direction for effecting opening of the sliding door and rotatable about the fixed pivot in a second direction for effecting closing of the sliding door;

a first input lever rotatable about an axis for receiving a force resulting from rotation of the inside handle to effect closing of the sliding door;

a second input lever rotatable about said axis for receiving a force resulting from rotation of the inside handle to effect opening of the sliding door;

a full opening lever operatively connected to the fully opened condition locking mechanism and rotatable on a shaft spaced apart from said axis of the first input lever for receiving a force resulting from rotation of the first input lever said full opening lever operatively connected to the second input lever; and a full closing lever operatively connected to the fully closed condition locking mechanism, said full closing lever being rotatable on said shaft and connected to the second input lever via a link mechanism, the rotation of the first input lever acting only upon the full opening lever for producing an unlatched state of the fully opened condition locking mechanism, the rotation of the second input lever acting upon both the full opening lever and the full closing lever for producing the unlatched state of the fully opened condition locking mechanism and an unlatched state of the fully closed condition locking mechanism.

2. A sliding door locking device as set forth in claim 1, including a spring applying an urging force to the first and second input levers for urging the first and second input levers to a neutral position, the first and second input levers each having an abutting portion for receiving a force resulting from rotation of the inside handle.

3. A sliding door locking device as set forth in claim 1, wherein the link mechanism connecting the second input lever and the full closing lever includes an intermediate lever and an output lever which are rotatably mounted on said shaft.

4. A sliding door locking device as set forth in claim 3, wherein the output lever includes an abutting portion which is engageable with a side of the full opening lever and an L-shaped cam slot in which is positioned a first pin which also passes through a slot in the full closing lever.

5. A sliding door locking device as set forth in claim 4, wherein the first pin passing through the L-shaped cam slot in the output lever is moved, upon actuation of a locking knob, into a horizontal portion of the L-shaped cam slot to prevent movement of the output lever from being transmitted to the full closing lever.

6. A sliding door locking device as set forth in claim 4, including a child protection mechanism for preventing unlatching of the fully closed condition locking mechanism, the intermediate lever having a slot in which is positioned a second pin which is engageable with the output lever, the second pin being operatively isolated from the output lever upon actuation of the child protecting mechanism.

7. A sliding door locking device as set forth in claim 3, wherein the output lever is connected to a rod which is adapted to be connected to an outside handle.

8. A sliding door locking device having a fully opened condition locking mechanism and a fully closed condition locking mechanism and operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism, the sliding door locking device comprising:

an inside handle rotatable about a fixed pivot in a first direction for effecting opening of the sliding door and rotatable about the fixed pivot in a second direction for effecting closing of the sliding door;

a first input lever rotatable about an axis for receiving a force resulting from rotation of the inside handle for effecting closing of the sliding door;

a second input lever rotatable about the axis for receiving a force resulting from rotation of the inside handle for effecting opening of the sliding door;

a full opening lever operatively connected to the fully opened condition locking mechanism and rotatable on a shaft that is spaced from said axis of the first input lever for receiving a force resulting from rotation of the first input lever; and a full closing lever operatively connected to the fully closed condition locking mechanism, said full closing lever being rotatable on the shaft and connected to the second input lever via a link mechanism, the first input lever acting upon only the full opening lever during rotation of the first input lever to produce an unlatched state of the fully opened condition locking mechanism, the second input lever acting upon at least the full closing lever during rotation of the second input lever to produce at least an unlatched state of the fully closed condition locking mechanism.

9. A sliding door locking device as set forth in claim 8, wherein the link mechanism connecting the second input lever and the full closing lever includes an intermediate lever and an output lever which are rotatably mounted on said shaft.

10. A sliding door locking device as set forth in claim 9, wherein the output lever includes an abutting portion which is engageable with a side of the full opening lever and an L-shaped cam slot in which is positioned a first pin which also passes through a slot in the full closing lever.

11. A sliding door locking device as set forth in claim 9, wherein the intermediate lever has a slot in which is positioned a second pin which is engageable with the output lever.

12. A sliding door locking device as set forth in claim 8, wherein the full closing lever is connected to the fully closed condition locking mechanism.

13. A sliding door locking device as set forth in claim 8, including an arm connected to the inside handle, the arm being connected to a handle lever that is rotatably supported on said fixed pivot.

14. A sliding door locking device as set forth in claim 13, including a projection extending from the handle lever, said first and second input levers each including an abutting portion, the projection being located between the abutting portion of the first input lever and the abutting portion of the second input lever.

15. A sliding door locking device having a fully opened condition locking mechanism and a fully closed condition locking mechanism and operational such that when a sliding door which is movable along a longitudinal direction of a vehicle body fully closes an opening of the vehicle body the sliding door is locked to the vehicle body by the fully closed condition locking mechanism and when the sliding door fully opens the opening the sliding door is locked to the vehicle body by the fully opened condition locking mechanism, the sliding door locking device comprising:

an inside handle rotatable about a fixed pivot in a first direction for effecting unlatching of the fully closed condition locking mechanism and rotatable about the fixed pivot in a second direction for effecting unlatching of the fully opened condition locking mechanism;

a first input lever rotatable about an axis and engageable by the inside handle during rotation of the inside handle in the second direction;

a second input lever rotatable about the axis and engageable by the inside handle during rotation of the inside handle in the first direction;

a full opening lever adapted to be connected to the fully opened condition locking mechanism, the first input lever being rotatable on a shaft that is spaced from said axis of the first input lever for rotating in response to rotational movement of the first input lever to effect unlatching of the fully opened condition locking mechanism; and a full closing lever adapted to be connected to the fully closed condition locking mechanism, the full closing lever being rotatable on said shaft and operatively connected to the second input lever for rotating in response to rotational movement of the second input lever to effect unlatching of the fully closed condition locking mechanism, the full closing lever being isolated from the first input lever so that rotational movement of the inner handle in the second direction is prevented from being transmitted to the full closing lever.

16. A sliding door locking device as set forth in claim 15 including a spring applying an urging force to the first and second input levers for urging the first and second input levers to a neutral position, the first and second input levers each having an abutting portion for receiving a force resulting from rotation of the inside handle.

17. A sliding door locking device as set forth in claim 15, including an intermediate lever and an output lever rotatably mounted on said shaft and connecting the full closing lever to the second input lever.

18. A sliding door locking device as set forth in claim 15, including an arm connected to the inside handle, the arm being connected to a handle lever that is rotatably supported on said fixed pivot.

19. A sliding door locking device as set forth in claim 18, including a projection extending from the handle lever, said first and second input levers each including an abutting portion, the projection being located between the abutting portion of the first input lever and the abutting portion of the second input lever.

* * * * *

UNITED STATES PATENT AND TRADEMARK OFFICE

CERTIFICATE OF CORRECTION

PATENT NO. : 6,032,987

DATED : March 7, 2000

INVENTOR(S) : FUKUMOTO, et al.

It is certified that error appears in the above-indentified patent and that said Letters Patent is hereby corrected as shown below:

On the Title Page:

[30] Foreign Application Priority Data

May 19, 1997 [JP] Japan.....9-142929

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*